United States Patent [19]

Harandi et al.

[11] Patent Number: 5,015,359

[45] Date of Patent: May 14, 1991

[54] HYDRODEWAXING METHOD WITH INTERSTATE RECOVERY OF OLEFIN

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 301,700

[22] Filed: Jan. 25, 1989

Related U.S. Application Data

[63] Continuation-in-part of Ser. No. 125,433, Jun. 30, 1986, abandoned.

[51] Int. Cl.[5] ..... C10G 65/10; C10G 13/00

[52] U.S. Cl. ..... 208/58; 208/84; 208/96; 208/97; 208/100; 208/27; 208/103; 208/111

[58] Field of Search ..... 208/57, 58, 59, 81, 208/84, 100, 101, 103, 111, 96, 97, 27

[56] References Cited

U.S. PATENT DOCUMENTS

| | | | |
|---|---|---|---|
| 3,702,818 | 11/1972 | Streed et al. | 208/59 |
| 3,755,138 | 8/1973 | Chen et al. | 208/111 |
| 4,176,048 | 11/1979 | Corns et al. | 208/59 |
| 4,414,097 | 11/1983 | Chester et al. | 208/59 |
| 4,648,957 | 3/1987 | Graziani et al. | 208/58 |

OTHER PUBLICATIONS

Voorhies and Smith, *Advances in Petroleum Chemistry and Refining*, Ed. John J. McKetta, Jr., Interscience Publishers: New York, 1964, vol. 8, pp. 171-174.

*Primary Examiner*—Anthony McFarlane
*Assistant Examiner*—Nhat Phan
*Attorney, Agent, or Firm*—Alexander J. McKillop; Charles J. Speciale; Malcolm D. Keen

[57] ABSTRACT

Hydrocarbon feeds are dewaxed and hydrotreated in a two-stage dewaxing-hydrotreating reactor system with interstage separation of olefinic and naphtha and light olefins. Separation of the naphtha and olefins is carried out by stripping the effluent from the dewaxing reactor with a stripping medium such as make-up hydrogen or vapor from the hydrotreater effluent. Hydrogen recycle for the dewaxer and the hydrotreater is taken from the stripper/separator after removal of the olefinic naphtha and removal of contaminants. Separation of the lighter olefins from the olefinic naphtha may be improved by the use of an oil solvent such as naphtha introduced into the top of the interstage stripper/-separator so that the recycle gas from the stripper/-separator is essentially free of wet gas and heavier fractions.

21 Claims, 5 Drawing Sheets

10
12
14
18
20
22
24
28
30
34
36
38
40
42
46
50
52
54
56
58
60
62
64
66
68
70
74
75
76
78
80
82
84
86
88
90
92
93
94
99
104
106
112
114
118
120
128
DL2

HYDRODEWAXING METHOD WITH INTERSTATE RECOVERY OF OLEFIN

CROSS-REFERENCE TO RELATED APPLICATION

This is a continuation-in-part of my prior application, Ser. No. 125,435, filed 30 Jun. 1986 now abandoned. The contents of Ser. No. 125,435 are incorporated in this application by reference.

FIELD OF THE INVENTION

This invention relates to a method for dewaxing a hydrocarbon feed such as a middle distillate or lubricant hydrocarbon fraction while producing light olefins and olefinic gasoline as useful by-products. More particularly, the present invention relates to a method and apparatus for dewaxing distillates and lubricant boiling range hydrocarbon liquids.

BACKGROUND OF THE INVENTION

The dewaxing of hydrocarbons to produce liquid products of lower pour point is a process of great commercial significance. Although alternatives exist, the use of shape-selective catalysts, such as the intermediate pore size zeolite catalysts, to selectively convert those paraffins that contribute the most to high pour points has many advantages over other methods. Thus, catalytic dewaxing over shape-selective zeolites will likely be the most commercially significant dewaxing process in the hydrocarbon processing industry.

Catalytic dewaxing of hydrocarbon oils to reduce the temperature at which the precipitation of waxy hydrocarbon occurs is a known process and is described, for example, in the *Oil and Gas Journal*, pages 69-73. A number of patents have also described catalytic dewaxing processes such as U.S. Pat. No. Reissue 28,398 which uses a dewaxing catalyst comprising zeolite ZSM-5. U.S. Pat. No. 3,956,102 describes a process gor hydrodewaxing a gas oil with a ZSM-5-type catalyst. U.S. Pat. No. 4,100,056 describes a mordenite catalyst containing a Group VI or Group VIII metal used to dewax a distillate from a waxy feed. U.S. Pat. No. 3,755,138 describes a process for mild solvent dewaxing to remove high quality wax from a lube stock, which is then catalytically dewaxed to specification pour point.

Catalytic dewaxing may be applied to both distillate and lubricant feedstocks. The Mobil Distillate Dewaxing (MDDW) and Lube Dewaxing (MLDW) processes now have widespread commercial acceptance and variations on both processes have been described. These processes are described in Catal. Rev.—Sci. Eng. 28 (2&3), 185-264 (1986), especially pages 241-247, to which reference is made for a description of these dewaxing processes as well as of the MOGD process.

Improvements to the basic catalytic lube dewaxing processes include multistage dewaxing in which the lube chargestock is cascaded from a first dewaxing reactor to subsequent dewaxing reactors as described in U.S. Pat. No. 4,648,957. In the process described in this patent light products are separated from the first hydrodewaxing reactor effluent and are hydrotreated and then mixed back with the dewaxed lube before being processed in another hydrodewaxing/hydrotreating step. Other multibed hydrodewaxing processes and apparatus are described in the literature such as that described in published European Application No. 86/310083.0.

These dewaxing processes, which employ an intermediate pore size zeolite such as ZSM-5 as the effective component of the dewaxing catalyst, produce significant quantities of olefins as a consequence of the shape-selective dewaxing reactions. The olefins produced in the dewaxing reactions include both light olefins, mainly $C_3$ and $C_4$ olefins as well as $C_{5+}$ olefins in the gasoline boiling range, as a result of which a relatively high octane olefinic naphtha is one of the by-products of the process. The reactions which take place in the dewaxing process are, essentially, shape-selective crackig of the waxy paraffinic components of the feed and although hydrogen is conventionally present to retard catalyst aging, together with a metal component such as nickel on the catalyst, the conditions employed are not conducive to saturation so that significant quantities of gasoline range and lighter olefins are produced in the process, as described in U.S. Pat. No. 4,695,364. In the dewaxing of lube boiling range hydrocarbons, as in the MLDW process, the effluent from the dewaxing reactor may be cascaded directly into a hydrotreating reactor in order to saturate and stabilize lube range olefin in the dewaxing products. Similarly, in distillate dewaxing, a hydrotreater may be provided in order to remove unsaturation unless the dewaxed distillate is combined with virgin distillate and treated together with it in the refinery CHD unit. In both these cases, however, the hydrogen consumption of the hydrocoating step is needlessly increased by the saturation of olefinic components outside the boiling range of the desired products, principally of $C_{5-}$ and gasoline rage olefins. To reduce hydrogen consumption it would be possible to arrange for separation between the dewaxing reactor and the hydrotreater but this may stil leave lower olefins to be carried over into the hydrotreater.

It has now been found that improved separation of the lower olefinic materials may be provided by stripping the dewaxed products prior to hydrotreating, preferably using an oil solvent such as naphtha which is fed into the top of the stripper/separator so that the recycle gas is essentially free of wet gas and heavier fractions. Operation in this manner confers several benefits. One is a significant reduction in the hydrogen consumption in the hydrotreating reactor since the majority of the light olefins are no longer hydrotreated in the hydrotreating reactor. In addition, the hydrogen circulation rate for the hydrotreating reactor can be better controlled so as to reduce the pressure drop across the hydrotreating reactor.

Alternatively, the hydrotreating reactor can be operated at a higher pressure level than the hydrodewaxing reactor; this affords the opportunity to modify the pour point of dewaxed lube products.

SUMMARY OF THE INVENTION

According to the present invention, the olefinic materials produced in the dewaxing, especially the olefinic gasoline, are removed from the effluent of the hydrodewaxing reactor prior to hydrotreating of the reactor effluent. To do this, a fractionator with an integrated stripping function is disposed downstream of the hydrodewaxer but upstream of the hydrotreating reactor. The separation of the light hydrodewaxing products in the fractionator may be enhanced by stripping with effluent vapor from the hydrotreating reactor, hydrogen make-up and/or hydrogen recycle as the stripping medium. Overall hydrogen make-up requirements are reduced in that the light hydrodewaxing products including the light ($C_5$-) olefins and olefinic gasoline, are not subject to hydrotreating in the hydrotreating reactor. Recoveries up to about 90% of the $C_5$+ gasoline, as well as up to 20% $C_3$ and up to 45% $C_4$ upstream of the hydrotreating reactor can be attained by the present invention.

The lower boiling components of the dewaxer effluent can be further treated to upgrade the naphtha fraction to high octane olefinic naphtha having an octane number of 90RON+O. Because the olefins are separated prior to hydrotreating, saturation of the olefins would produce a gasoline of low octane. The resulting olefinic gasoline can be directly blended into the existing gasoline pool. The recovered $C_3/C_4$ olefins can be utilized as alkylation unit feed, or as fuel gas conversion unit feedstock e.g. in an MOGDL unit as described in U.S. Pat. No. 4,695,364, to which reference is made for details of such a conversion.

The present olefin separation/stripping technique may be employed either with the lube boiling range feeds, as with the MLDW process or to produce middle distillate fuels e.g. kerosene, jet fuel etc., as in the distillate dewaxing (MDDW) process. Thus, the feed may be a neutral or residual lube feed, e.g. light neutral, heavy neutral or bright stock, or an atmospheric or vacuum gas oil feed for distillate fuel production.

THE DRAWINGS

DETAILED DESCRIPTION

Figure 1:
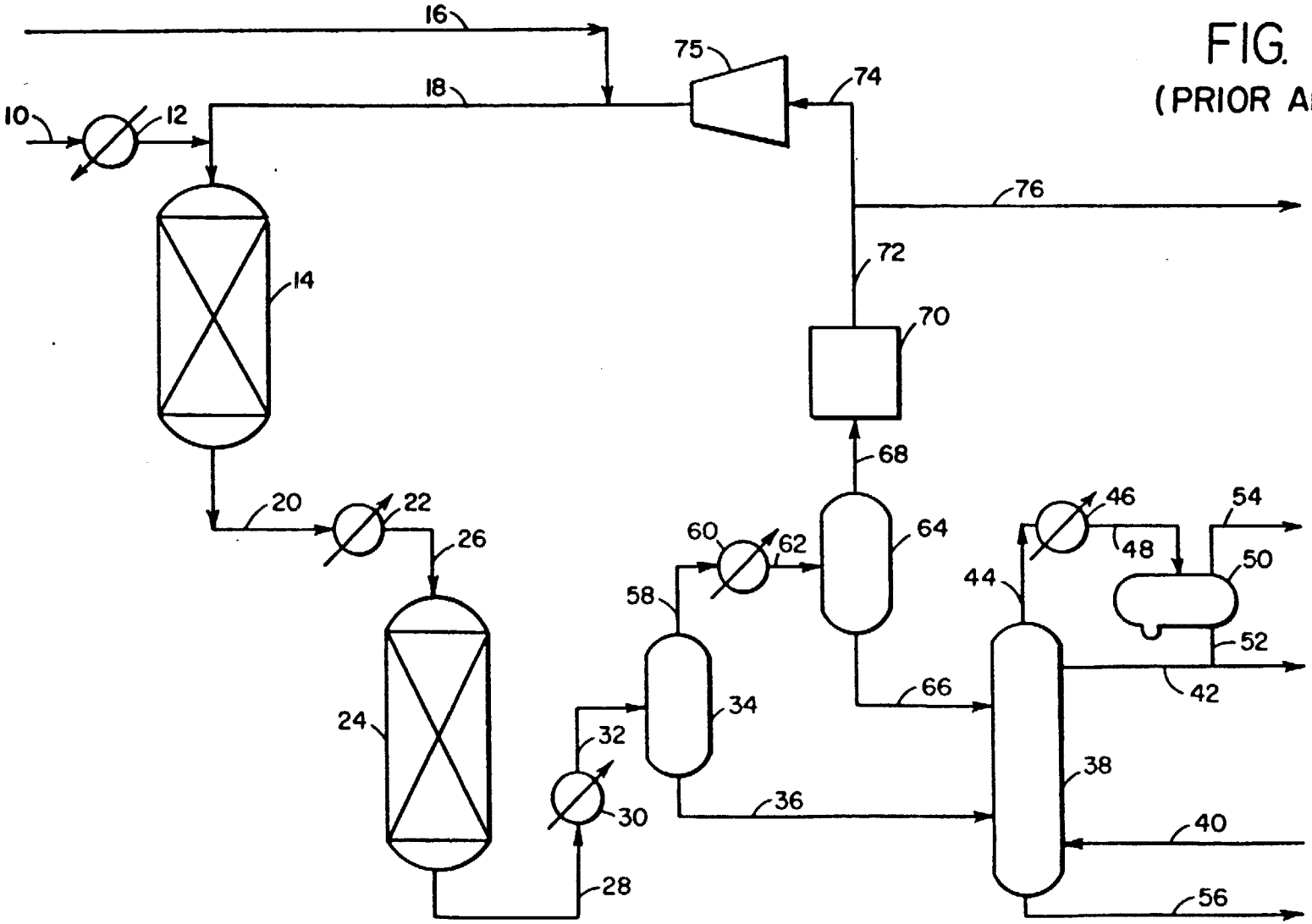
FIG. 1 (PRIOR ART)
FIG. 1 is a schematic representation of a conventional hydrodewaxing process.

FIG. 1 shows a simplified schematic of a lube hydrodewaxing process in which a hydrocarbon fraction such as a lube range raffinate feed is fed via conduit 10 through heat exchanger 12 to a hydrodewaxing reactor 14. A source of hydrogen (not shown) is fed through conduits 16, to hydrodewaxing reactor 14 with make-up hydrogen supplied through line 18. Conventional temperatures for the mixture of lube raffinate feed and hydrogen gas fed to the hydrodewaxing reactor 14 typically vary between about 550° and about 675° F. during the course of the dewaxing cycle, at about 527-557 psig. The dewaxed reactor effluent exiting through conduit 20 is at a temperature of about 550°-675° F. and a pressure of about 516-531 psig. This effluent passes through heat exchanger 22 and conduit 26 into hydrotreating reactor 24, typically at a temperature of about 500° F. The hydrotreater reactor effluent leaving hydrotreating reactor 24 through conduit 28 is typically at a temperature about 515° F. as it passes through heat exchanger 30 and conduit 32 as it is fed to separator 34. The bottoms from separator 34 are fed by conduit 36 to naphtha stripper 38. Separator 34 is normally maintained at a pressure less than that of hydrotreater 24, typically about 485 psig. Naphtha stripper 38 operates in a conventional manner with stream introduced through conduit 40 into the lower portion of naphtha stripper 38 to separate naphtha and light gases from the lube oil and kerosene leaving naphtha stripper 38 as the bottoms fraction through conduit 56. After passing the stripper overhead in conduit 44 through heat exchanger 46 and conduit 48 to settling tank 50, unstabilized naphtha is withdrawn through conduit 52 while lighter gases are withdrawn through conduit 54 for use as fuel or feed to an MOGDL unit, as noted above. The bottoms effluent from stripper 38 comprising lube oil and kerosene, are conveyed in conduit 56, to downstream processing units, such as a vacuum stripper (not shown).

The lighter effluent leaving separator 34 through conduit 58 passes through heat exchanger 60 and conduit 62 to separator 64. The bottoms from separator 64 are fed, through conduit 66 to an intermediate level in the naphtha stripper 38. Contaminants such as hydrogen sulfide ($H_2S$) plus nitrogen are removed from the effluent leaving separator 64 through conduit 68 in scrubber 70. The hydrogen leaving scrubber 70, via line 72, is partly recycled through conduit 74 and recycle compressor 75, to hydrodewaxing reactor 14 and partly removed through conduit 76.

Figure 2:
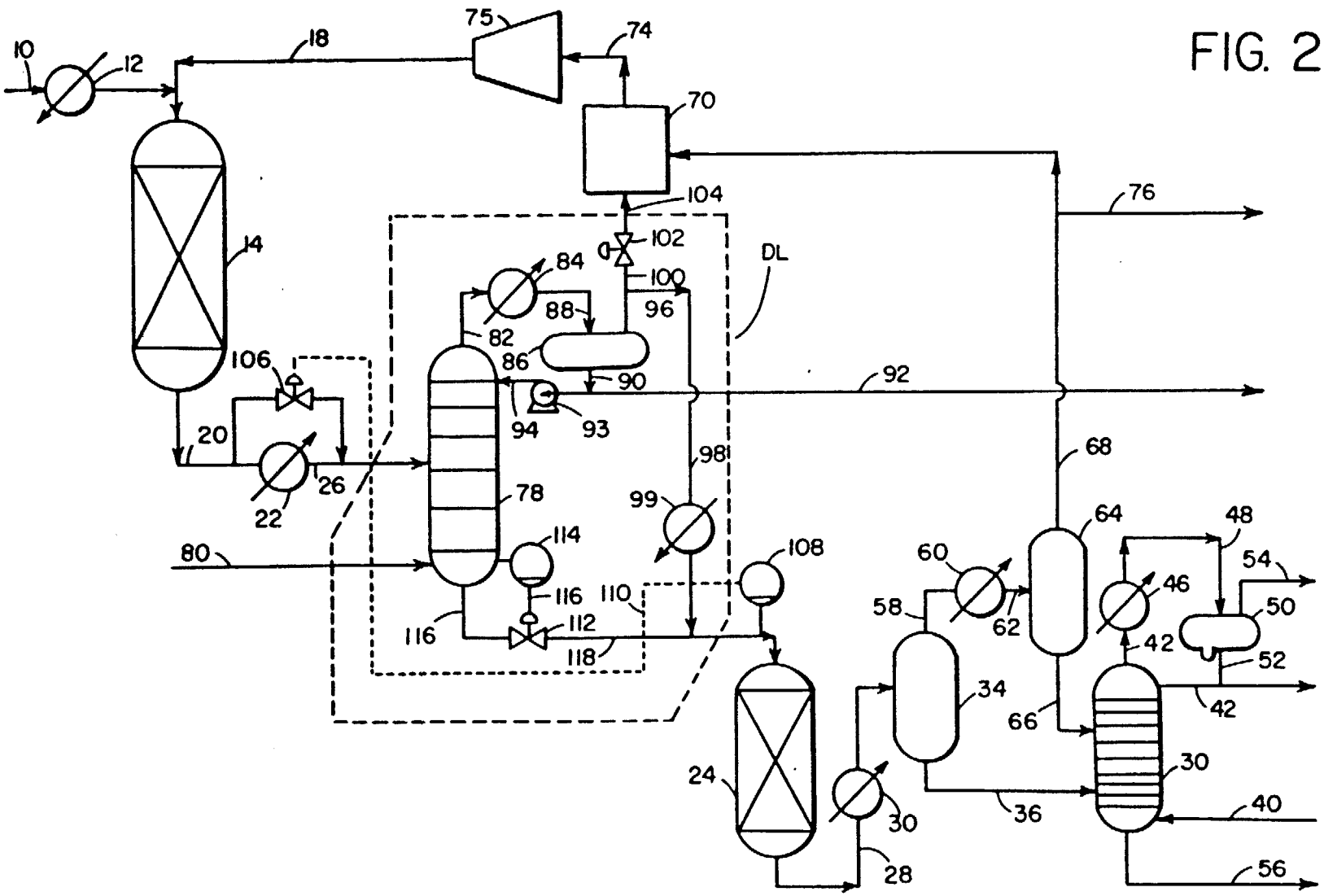
FIG. 2 is a schematic representation of a hydrodewaxing unit, including an olefin recovery section.

FIG. 2 shows one dewaxing unit with intermediate separation and stripping, as provided by the present invention. (Like reference numerals are used throughout the specification and drawings to describe like elements and, as indicated by these numerals, the unit is otherwise like that of FIG. 1.) The additional facilities shown within dotted line DL of FIG. 2 comprise an olefin fractionator 78 functioning as a stripper/separator to which is fed the effluent from hydrodewaxing reactor 14. A source of make-up hydrogen is introduced through inlet 80 to fractionator 78 to strip the lighter olefinic dewaxing products from the hydrodewaxer effluent. These olefins leave the fractionator as overhead and are conveyed through outlet 82, heat exchanger 84 and conduit 88, to gas/liquid phase separator 86. The bottoms from separator 86, comprising unstabilized olfinic naphtha, are removed through conduit 90, and partially withdrawn through conduit 92. Fractionator reflux is provided by pump 93 and conduit 94 which feed the olefinic naphtha to olefinic fractionator 78. Light gases from separator 86 are removed via conduit 96 and are partially used as a source of feed for the hydrotreating reactor, via conduit 98 and heat exchanger 99 to the reactor. Part of the light gases passes through conduit 100, flow control valve 102 and conduit 104, to scrubber 70 so as to provide a source of high purity recycle hydrogen for use as feed to hydrodewaxing reactor 14, conveyed through conduits 74 and 18.

Variable flow control valve 106 is used to control the flow of dewaxed effluent through heat exchanger 22 to fractionator 78. For increased fractionation efficiency, heat exchanger 22 may be by-passed by controller 106 so that the flow may be sent directly to the fractionator 78, preferably to a tray below the mainfeed tray where stream 26 from heat exchanger 22 is fed to the tower. Variable flow control valve 106 is actuated in response to a signal from temperature sensor 108 on line 118 via communication line 110. An additional flow control valve 112 is connected by communication line 116 to sensor 114 at the bottom of tower 78 to control the flow of the stripped, dewaxed effluent through conduit 118 from fractionator 78 to hydrotreater 24.

As can be appreciated from the process schematically illustrated in FIG. 2 the effluent of hydrodewaxing reactor 14 is stripped in fractionator 78 to remove olefins and the light product leaving fractionator 78 through outlet 82 primarily comprises $C_3$, $C_4$ olefins and $C_{5+}$ gasoline. The line products recovered from the fractionator overhead can be sent to the cracking unit (FCCU) unsaturated gas plant for further separation into $C_3$, $C_4$ anmd $C_{5+}$ components. The removal of the olefinic fraction also permits better control of the hydrogen circulation rate for the hydrotreating reactor by feeding hydrogen-containing overhead streams through conduit 98 to hydrotreater 24 thereby permitting a reduction in the pressure in the hydrotreating reactor and its associated separation system pressure drop.

Unrecovered olefinic $C_3/C_4$ components plus ethene leaving the fractionator section through conduit 104 are recycled with the hydrogen, through conduit 18, to hydrodewaxing reactor 14 and may undergo conversion to olefinic gasoline over the catalyst used in hydrodewaxing reactor 14 by olefin-to-gasoline oligomerization (MOG type reactions). This is not possible in the conventional process illustrated in FIG. 1 since the entire dewaxer effluent is processed in the hydrotreating reactor and this converts all of the olefins in the effluent to paraffins.

Figure 3:
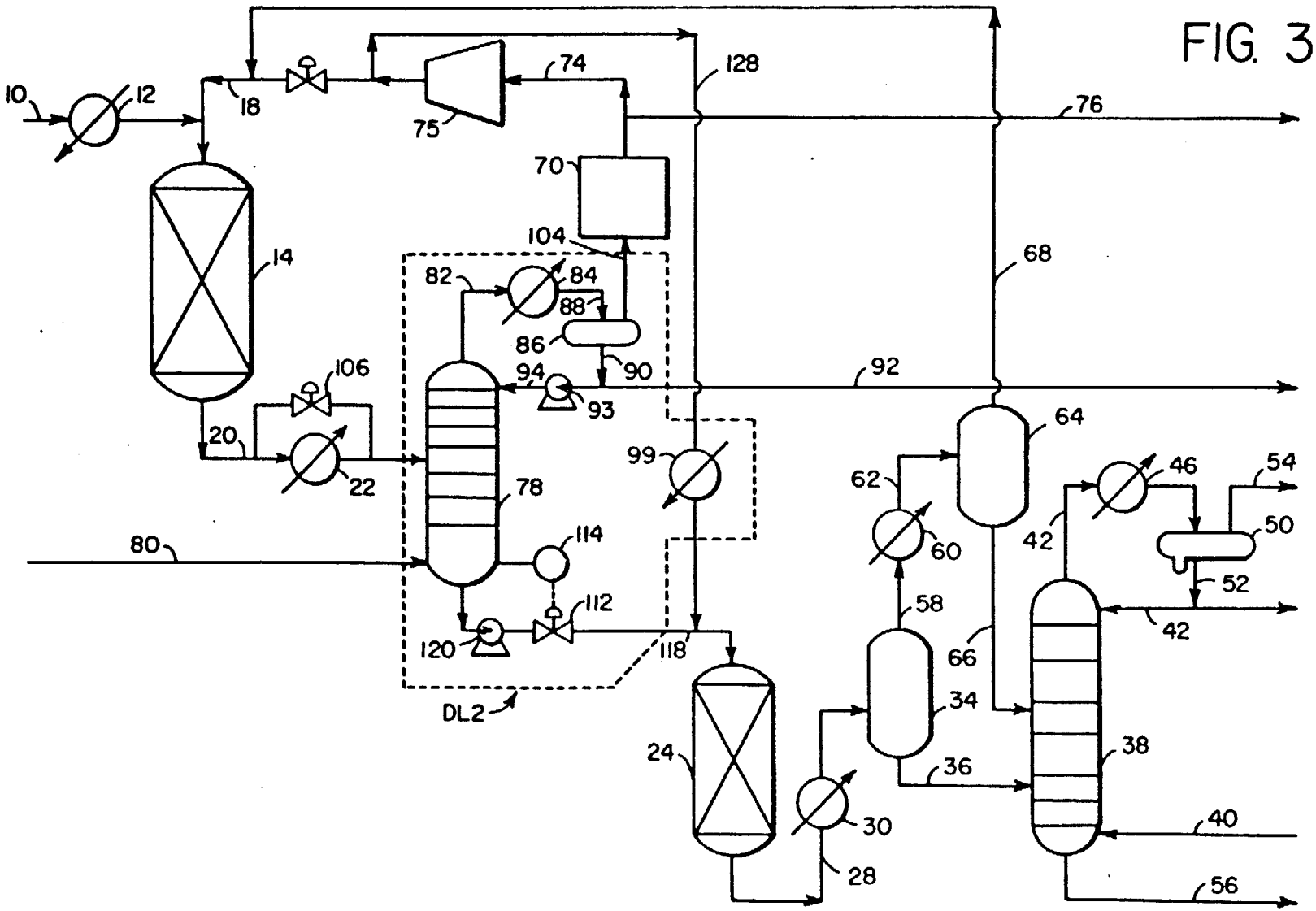
FIG. 3 is a schematic representation of another dewaxing unit with an olefin recovery section.

Additional advantages may be achieved by the alternative embodiment illustrated in FIG. 3. As in FIG. 2, like numerals designate like elements. The dotted line DL2 illustrates the added features of this embodiment. In FIG. 3, the hydrotreating reactor 24 can be operated at a pressure higher than that of the hydrodewaxing reactor 14 by providing a pump 120 to increase the pressure of the stripped hydrodewaxing effluent leaving fractionator 78 through variable flow control valve 112 and conduit 118. High purity hydrogen for the hydrotreater is provided at an appropriate pressure from recycle compressor via conduit 128.

Figure 4:
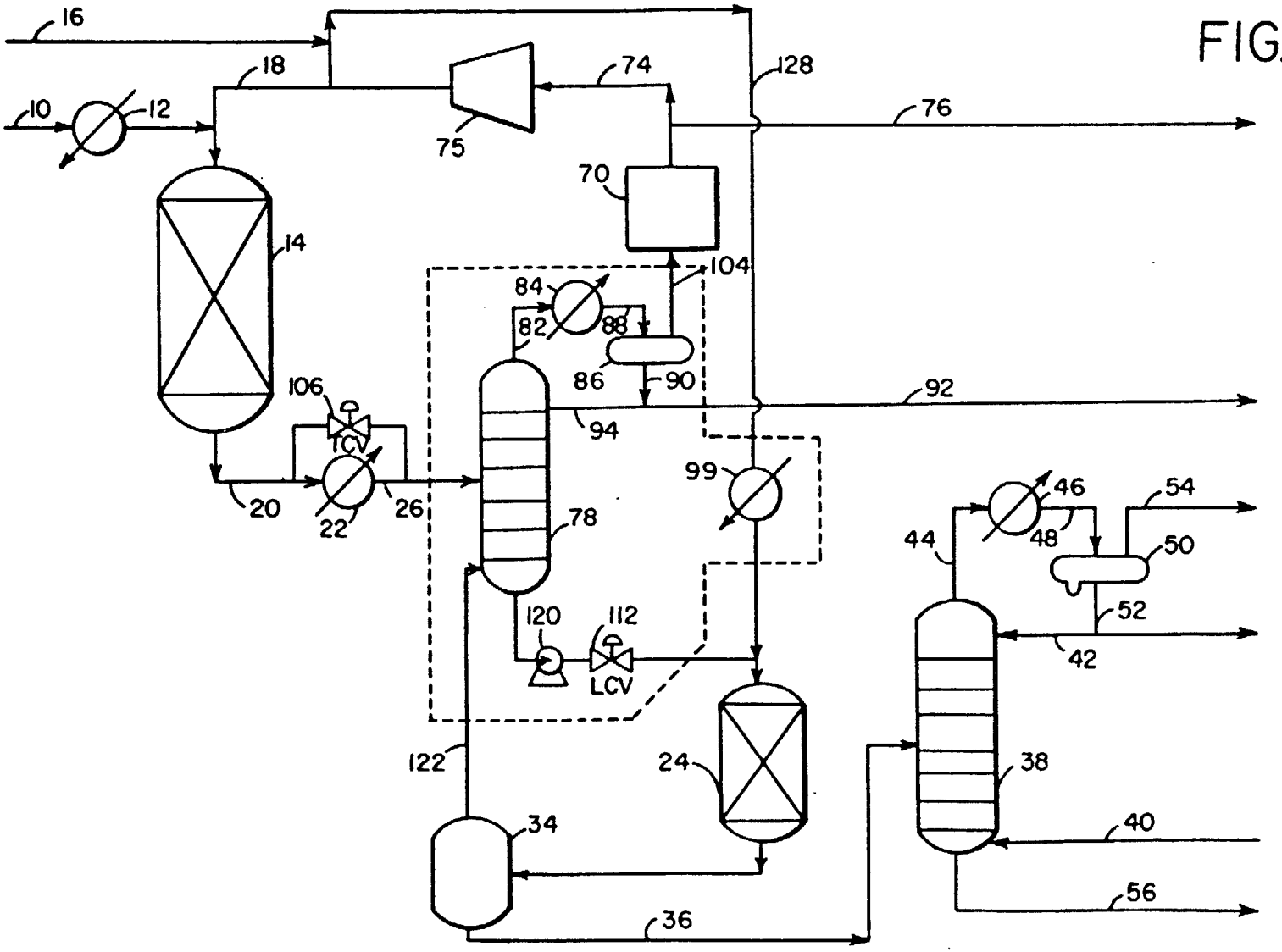
FIG. 4 is a schematic representation of another dewaxing unit with an olefin recovery section.

In a further alternative shown in FIG. 4 the hydrotreating reactor effluent vapor is used as a stripping medium in fractionator 78. As in the previous figures like reference numerals designator like elements. Fractionator 78 utilizes, as a stripping medium, the hydrotreating reactor effluent vapor from separator 34 which is fed through inlet 122, to the bottom of fractionator 78. This is especially beneficial if severe stripping of the hydrodewaxing reactor effluent is desired in olefinic fractionator 78 since the quantity of effluent vapor from separator 34 will usually exceed the quantity of make-up hydrogen.

Figure 5:
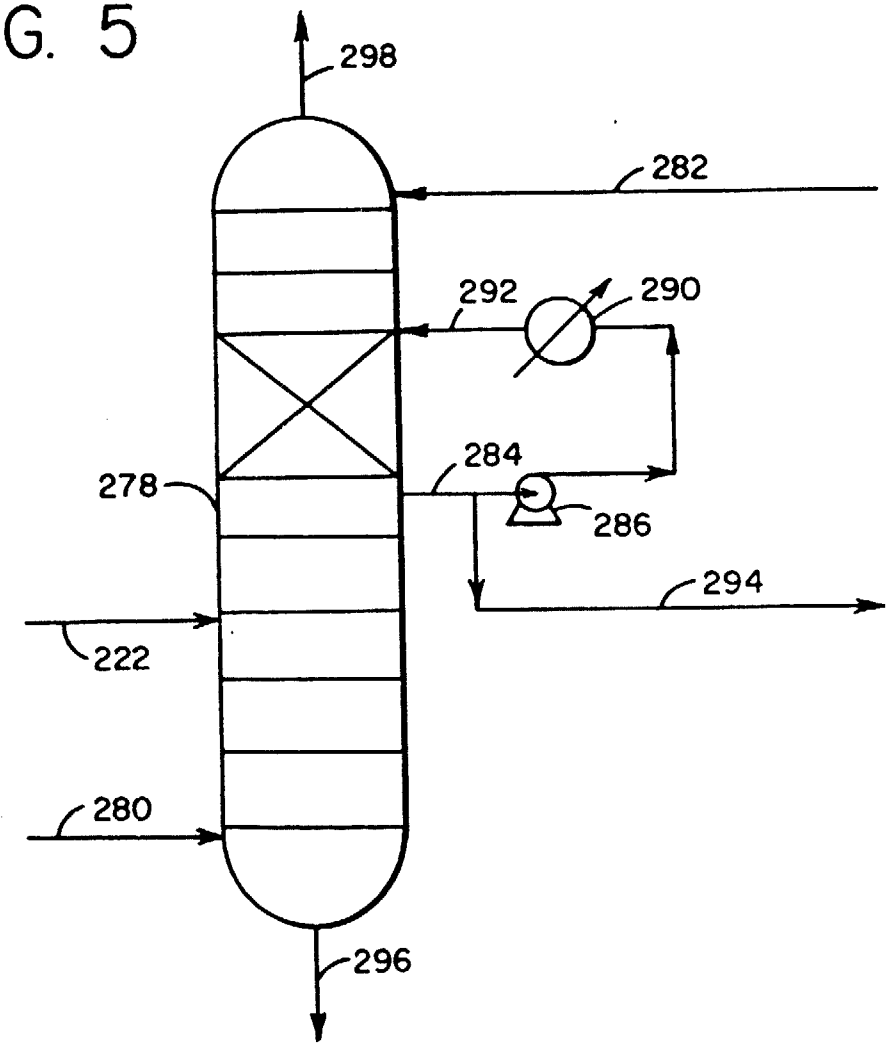
FIG. 5 is a schematic representation of a fractionator for achieving a higher olefinic $C_3/C_4$ recovery.

As noted, with regard to the embodiments described in FIGS. 2-4, the light overhead fractions ($C_3$, $C_4$) from the fractionator are mostly carried into the gaseous phase. Higher $C_3/C_4$ recoveries can be obtained by employing the fractionator illustated in FIG. 5. Fractionator 278 has input conduits 222 for introducing the effluent from a hydrodewaxing reactor (not shown) as well as a stripping medium conduit 280 for introducing a stripping gas, such as hydrogen or hydrotreating reactant effluent vapor. A lean oil may be introduced through conduit 282 to the top of fractionator 278 with the unstabilized olefinic naphtha plus rich oil being with drawn from fractionator 278 through conduit 284. A portion of the unstabilized olefinic naphtha plus rich oil may be returned as reflux through pump 236, conduit 288, cooler 290 and conduit 292 so as to be reintroduced to the fractionator 278. A portion of the unstabalized olefinic naphtha plus rich oil may be withdrawn via conduit 294 to further downstream treatment sections (not shown). The bottoms from fractionator 278 comprise an effluent including lube oil and kerosene which leave through conduit 296 while the top olefin fractionator 278 produces an overhead comprising treat gas withdrawn through conduit 298. The hydrogen purity of the treat gas is significantly improved as compared with the conventional fractionators.

It is possible to upgrade about 90% (based on the FIG. 2 configuration) of the hydrodewaxing reactor effluent naphtha to high octane olefinic naphtha with an octane number of 90 (R+0). This is an improvement of approximately 15 to 20 octane numbers over that obtainable by hydrotreating the naphtha. The olefinic gasoline so produced can be directly blended into the gasoline pool after treating, reducing the load on the hydrotreater, which permits processing more hydrocarbons per catalyst (weight basis).

The present invention permits the recovery of approximately 20% of olefinic $C_3$ and up to about 45% of the $C_4$ produced in the hydrodewaxing reactor (based on FIG. 2 configuration). By removing these olefins from the dewaxing effluent before introduction into the hydrotreating reactor, hydrogen consumption is significantly reduced because hydrogen is not consumed in saturating the olefins in the hydrotreater 24.

Significant advantages are achieved as by-products of the present invention including production of recycle gas of higher hydrogen purity than previously obtainable. In addition, hydrogen circulation rate and overall operating pressures may be selected so that hydrotreating may be accomplished at a higher pressure than the hydrodewaxing step. Moreover stripping steam requirements and stripper size for the naphtha stripper can be significantly reduced as a result of the removal of the olefinic fraction at an earlier stage in the unit.

Although the yield of olefin depends on the chargestock, the amount of $C_3$ olefins, $C_4$ olefins and $C_{5+}$ gasoline produced in a typical light neutral lube dewaxing process, in which a cracking reactor is followed by a hydrotreating reactor are 3.1, 7.0 and 25.0 volume percent of the fresh feed, respectively. Based on these values for a 10,000 BPSD approximately (60), (300), and (2,200) BPSD of $C_3$ olefins, $C_4$ olefins and olefinic naphtha can be recovered (based on FIG. 2 configuration). This can be achieved in a fractionator having a diameter of approximately 4 feet (1.2 m) and 15 trays. By effecting olefin separation between the dewaxer and the hydrotreater the naphtha stripper diameter can be reduced although the treat gas compressor size will need to be increased to handle the increased gas volume at this stage.

The olefins recovery does not effect the lube recovery or lube quality. All the lube components leave the olefin fractionator as bottoms and are mixed with the required volume of hydrogen before entering the hydrotreating reactor. The naphtha end point can be controlled by use of reflux as previously described.

In a similar way to that described above for lube production, the interstage separation of the olefinic cracking products produced by the dewaxing reactions may also be affected in distillate dewaxing processes using a similar intermediate pore size catalyst such as ZSM-5, as in the Mobil Distillate Dewaxing (MDDW) process. The dewaxing and hydrotreating processes will be carried out under conventional conditions for the appropriate feeds which are usually an atmospheric or vacuum gas oil. Dewaxing temperatures are normally higher at end of cycle than for lube dewaxing, typically up to 800° F. (about 425° C.) with start of cycle temperatures being dependent on product pour point but typically about 550° F. (about 290° C.). Hydrogen pressures are similar to those in the lube dewaxing with pressures up to 3000 psig (about 21,000 kPa abs.); lower pressures around 400 psig (2860 kPa abs) $H_2$ partial pressure are adequate. Hydrogen circulation rates of up to 5000, typically about 2000 SCF/Bbl (up to 890, typically 356 n.l.l.$^{-1}$) are useful with space velocities of about 0.1 to 5, usually 0.5-2 LHSV.

Application of the present olefin separation-stripping technique to distillate dewaxing will follow the same lines as described in detail above, except that a relatively taller fractionator tower will be required in order to achieve the desired degree of product separation in view of relative closeness of boiling points with distilate products and feeds (although some distillate is present with the lube dewaxing process it constitutes only a small proportion of the total liquid product). a higher reflux ratio, with a consequent effect on tower size may also be needed to separate products adequately although the light olefins will be removed in the $C_4$ olefin fractionator in the manner described above.

We claim:

1. A process for dewaxing a hydrocarbon feed comprising:

(a) dewaxing the feed by contacting a hydrocarbon feed in the presence of hydrogen with a dewaxing catalyst;

(b) obtaining a dewaxed effluent;

(c) stripping the dewaxed effluent with a gaseous stripping medium to form a dewaxed fraction, a light olefinic gas fraction and an olefinic gasoline fraction;

(d) separation the dewaxed fraction from the olefinic gasoline fraction and the light olefinic gas friction, and (e) hydrotreating the dewaxed fraction in the presence of hydrogen with a hydrotreating catalyst.

2. A process according to claim 1 in which the dewaxing catalyst comprises an intermediate pore size zeolite.

3. A process according to claim 2 in which the intermediate pore size zeolite comprises ZSM-5.

4. A process according to claim 1 in which the stripping medium comprises make-up hydrogen for the dewaxing process.

5. A process according to claim 1 in which the stripping medium comprises effluent vapor from the hydrotreating step.

6. A process according to claim 5 in which the effluent vapor from the hydrotreating step is a vapor separated from the hydrotreating effluent in a vapor-liquid separator.

7. A process according to claim 1 which includes separating the light olefinic gas fraction from the olefinic gasoline fraction.

8. A process according to claim 7 in which the light olefinic gas fraction is recycled to the dewaxing step.

9. A process according to claim 8 in which the light olefinic gas fraction is converted to gasoline in the dewaxing step.

10. A process according to claim 1 which includes the step of separating contaminants from the light olefinic gas fraction.

11. A process according to claim 10 which includes recycling the light olefinic gas fraction to the dewaxing step.

12. A process according to claim 7 in which the light olefinic gas fraction is mixed with the dewaxed fraction prior to the hydrotreating step.

13. A process according to claim 1 in which the hydrotreating step is operated at a higher pressure than the dewaxing step and in which the light olefinic gas fraction is passed to the hydrotreating step at the pressure of the hydrotreating step.

14. A process according to claim 13 in which effluent vapor from the hydrotreating step is passed to the dewaxing step.

15. A process according to claim 1 in which the dewaxed effluent is stripped in the presence of an oil solvent for light hydrocarbons boiling below the gasoline boiling range to dissolve the light hydrocarbons in the oil solvent.

16. A process according to claim 15 in which the dewaxed effluent is stripped in the presence of a countercurrent flow of the oil solvent to dissolve the light hydrocarbons in the oil solvent.

17. A process according to claim 16 in which the oil solvent comprises naphtha.

18. A process according to claim 16 in which the oil solvent containing dissolved light hydrocarbons is separated from the fraction containing the olefinic gasoline.

19. A process according to claim 1 in which the hydrocarbon feed comprises a lubricant boiling range feed.

20. A process according to claim 1 in which the hydrocarbon feed comprises a distillate feed.

21. A process according to claim 20 in which the hydrocarbon feed comprises an atmospheric gas oil or a vacuum gas oil.

• • • • •